United States Patent [19]

Ryu et al.

[11] 4,383,931

[45] May 17, 1983

[54] LUBRICATING OILS CONTAINING MOLYBDENYL CHELATES

[75] Inventors: Yumi P. Ryu, Murrysville Borough; Robert J. Hartle, Gibsonia, both of Pa.

[73] Assignee: Gulf Research & Development Company, Pittsburgh, Pa.

[21] Appl. No.: 326,698

[22] Filed: Dec. 2, 1981

[51] Int. Cl.[3] ..... C10M 1/38; C10M 1/54

[52] U.S. Cl. ..... 252/32.7 E; 252/42.7; 252/49.7; 252/32.7 HC; 252/47

[58] Field of Search ..... 252/32.7 E, 42.7, 49.7, 252/47, 327 HC

[56] References Cited

U.S. PATENT DOCUMENTS

| | | | |
|---|---|---|---|
| 2,161,184 | 6/1939 | McKone et al. | 252/49.7 |
| 3,184,410 | 5/1965 | Bretherick | 252/49.7 |
| 3,210,275 | 10/1965 | Durr, Jr. | 252/32.7 E |

*Primary Examiner*—Jacqueline V. Howard

*Attorney, Agent, or Firm*—Deane E. Keith; Forrest D. Stine; Donald L. Rose

[57] ABSTRACT

The antifriction properties of a lubricating oil are enhanced by the addition of a minor amount of an oil-soluble molybdenyl bis-$\beta$-diketonate. The antifriction properties are particularly enhanced when the molybdenyl bis-$\beta$-diketonate is used in combination with an oil-soluble active sulfur donor, such as a zinc dialkyldithiophosphate.

6 Claims, No Drawings

LUBRICATING OILS CONTAINING MOLYBDENYL CHELATES

SUMMARY OF THE INVENTION

This invention relates to hydrocarbon lubricating oils having improved antifriction properties comprising a minor amount of an oil-soluble molybdenyl bis-β-diketonate. These molybdenyl bis-β-diketonates are particularly effective in the improvement of the antifriction properties of a lubricating oil when they are used in combination with an oil-soluble active sulfur donor.

DESCRIPTION OF THE INVENTION

The antifriction characteristics imparted by sulfur compounds of molybdenum when added to lubricating oils are well known and have been extensively studied. Molybdenum disulfide, being insoluble in lubricating oil, must be used as a minute disperson in the oil, giving the oil the black appearance of spent motor oil. A number of oil-soluble compounds of molybdenum and sulfur have been studied and have been found to be deficient for various reasons, including stability problems, solubility problems, cost, formation of acidic by-products, interference with other additives and the like. A commercially suitable oil-soluble compound of molybdenum and sulfur is still being sought as an antifriction lube oil additive.

We have discovered that certain oil-soluble, non-sulfur-containing molybdenyl chelates improve the antifriction properties of lubricating oils, and this improvement is particularly effective when these chelates are used in combination with an active sulfur donor compound in the oil. Thus, we have found that certain molybdenyl bis-β-diketonates which are oil soluble and free of sulfur are especially effective for the reduction of the coefficient of friction of a lubricating oil when a sulfur donor compound, such as a zinc dialkyldithiophosphate or a zinc dialkyldithiocarbamate, and the like, is also present in the oil.

The molybdenyl chelates which are useful for the improvement in the antifriction properties of lubricating oils can be represented by the following formula:

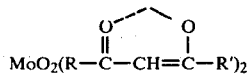

where R and R′ are independently selected from the group consisting of alkyl, aryl, aralkyl, alkaryl and cycloalkyl radicals containing from 1 to about 12 carbon atoms, preferably 1 to about 6 carbon atoms, and the sum of the carbon atoms in said radicals is 3 to about 24, preferably 3 to about 12 carbon atoms. Examples of such radicals are methyl, ethyl, propyl, isopropyl, n-butyl, sec-butyl, tertiary butyl, isobutyl, n-amyl, tertiary amyl, n-hexyl, n-heptyl, triethylmethyl, n-octyl, isooctyl, nonyl, decyl, undecyl, dodecyl, phenyl, naphthyl, benzyl, phenethyl, tolyl, xylyl, methylnaphthyl, ethylphenyl, propylphenyl, butylphenyl, amylphenyl, hexylphenyl, diethylphenyl, dipropylphenyl, trimethylphenyl, triethylphenyl, cyclopentyl, cyclohexyl, cyclooctyl, and the like.

Representative examples of molybdenyl bis-β-diketonates which are useful in improving the antifriction properties of lubricating oils according to this invention are listed below:

molybdenyl bis(2,4-hexanedionate)
molybdenyl bis(2,4-heptanedionate)
molybdenyl bis(2,4-octanedionate)
molybdenyl bis(3,5-heptanedionate)
molybdenyl bis(3,5-octanedionate)
molybdenyl bis(3,5-nonanedionate)
molybdenyl bis(4,6-nonanedionate)
molybdenyl bis(4,6-decanedionate)
molybdenyl bis(5,7-undecanedionate)
molybdenyl bis(5,7-dodecanedionate)
molydbenyl bis(6,8-tridecanedionate)
molybdenyl bis(5,7-tetradecanedionate)
molybdenyl bis(7,9-pentadecanedionate)
molybdenyl bis(7,9-hexadecanedionate)
molybdenyl bis(8,10-heptadecanedionate)
molybdenyl bis(8,10-octadecanedionate)
molybdenyl bis(9,11-nonadecanedionate)
molybdenyl bis(9,11-eicosanedionate)
molybdenyl bis(10,12-heneicosanedionate)
molybdenyl bis(10,12-docosanedionate)
molybdenyl bis(11,13-tricosanedionate)
molybdenyl bis(11,13-tetracosanedionate)
molybdenyl bis(12,14-pentacosanedionate)
molybdenyl bis(12,14-hexacosanedionate)
molybdenyl bis(13,15-heptacosanedionate)
molybdenyl bis(2,2-dimethyl-3,5-hexanedionate)
molybdenyl bis(2,2-dimethyl-3,5-heptanedionate)
molybdenyl bis(2,2-dimethyl-3,5-octanedionate)
molybdenyl bis(2,2-dimethyl-3,5-nonanedionate)
molybdenyl bis(2,6-dimethyl-3,5-heptanedionate)
molybdenyl bis(2,7-dimethyl-3,5-octanedionate)
molybdenyl bis(2,2,7-trimethyl-3,5-octanedionate)
molybdenyl bis(2,2,6,6-tetramethyl-3,5-heptanedionate)
molybdenyl bis(3,3,7,7-tetraethyl-4,6-nonanedionate)
molybdenyl bis(1-phenyl-1,3-butanedionate)
molybdenyl bis(1-phenyl-1,3-heptanedionate)
molybdenyl bis(1-phenyl-1,3-undecanedionate)
molybdenyl bis(1-phenyl-1,3-pentadecanedionate)
molybdenyl bis(1-napthyl-1,3-butanedionate)
molybdenyl bis(1-benzyl-1,3-butanedionate)
molybdenyl bis(1-tolyl-1,3-butanedionate)
molybdenyl bis(1-cyclohexyl-1,3-butanedionate)
molybdenyl bis(1,3-diphenyl-1,3-propanedionate)
molybdenyl bis(1,3-dinapthyl-1,3-propanedionate)
molybdenyl bis(1,3-dibenzyl-1,3-propanedionate)
molybdenyl bis(1,3-ditolyl-1,3-propanedionate)
molybdenyl bis(1,3-dicyclohexyl-1,3-propanedionate)

The preferred molybdenyl bis-β-diketonates for use as an oil additive in our invention are those chelates in which each of the R and R′ groups is branched-chain alkyl having from three to about eight carbon atoms, cycloalkyl having from five to about seven carbon atoms, and mono- and dialkyl-substituted phenyl or naphthyl in which the alkyl has from one to about three carbon atoms.

The molybdenyl bis-β-diketonates can be prepared by a ligand exchange reaction between solid molybdenyl bisacetylacetonate and liquid or solid β-diketones having a higher carbon number than acetylacetone. In the process, a two-phase mixture of the solid molybdenyl bisacetylacetone and the desired liquid or solid β-diketone are heated together until a single phase liquid solution is obtained. Freed acetylacetone is removed by distillation at an appropriate temperature and pressure to enhance the reaction. At the completion of the reaction, excess unreacted higher β-diketone can be removed, if desired, by distillation or by extraction with a suitable solvent.

In order for stoichiometric reaction to take place, at least two mols of the β-diketone are employed for every mol of molybdenyl bisacetylacetonate that is used. However, it is preferred to use an excess of up to about five mols of the β-diketone for every mol of the molybdenyl bisacetylacetonate to ensure that a complete exchange of the higher β-diketone with the acetylacetone takes place. In the procedure for carrying out the reaction, the freed acetylacetone is removed from the reaction system by distillation as the reaction progresses. This requires a proper correlation of the temperature and pressure to ensure that this separation is accomplished.

As described, the acetylacetone is removed from the reactor to ensure completion of the reaction to the molybdenyl bis-β-diketonate. The temperature and pressure of the reactor can initially be set at a level that will remove free acetylacetone as soon as the reactants are mixed together. Alternatively, the reactants can be reacted at atmospheric pressure with the pressure then reduced to remove the acetylacetone. A reaction temperature between about 50° C. and about 200° C. is suitable, with a temperature within a range of about 90° C. to about 150° C. being preferred. Since pressure is not critical to the reaction, the entire reaction can be conducted at atmospheric pressure. However, a reduced pressure of about 20 to 200 mm of mercury is preferred to effect acetylacetone removal at a more moderate temperature than would be required for its removal at atmospheric pressure. A distillation column may be desirable to effect separation of the acetylacetone from the other β-diketone in the reactor.

The molybdenyl bis-β-diketonates having lower alkyl substituents are liquid at normal conditions, while those having aromatic substituents may be solids. The purified straight-chain liquid products tend to be unstable in air, forming hexane-insoluble blue solids. The chelates having branched-chain alkyl groups tend to be more stable than those having straight-chain alkyl groups. Since the presence of a trace amount of acetylacetone in the liquid product increases its air instability, complete removal of the acetylacetone is desirable. However, the presence of unreacted higher β-diketone stabilizes the product. Therefore, the presence in the molybdenyl product of up to about 50 mol percent of the higher β-diketone may be desirable. The solid products are generally stable in air. All of the products decompose upon standing when dissolved in organic solvents such as hexane, chloroform, toluene, mineral oil and the like, rapidly forming blue solids. On the other hand, we have found that these molybdenyl bis-β-diketonates are very stable when dissolved in a formulated engine oil. The blue solids resulting from the partial decomposition have been found to have a higher proportion of molybdenum than is present in the molybdenum bis-β-diketonate prior to its decomposition.

The molybdenyl bis-β-diketonate can be used to effect an improvement in the antifriction properties of a lubricating oil in an amount between about 0.05 and about six weight percent of the formulated oil, preferably an amount between about 0.2 and about three percent. Following acetylacetone removal, any excess amount of the unreacted β-diketone that was used in the preparation of the molybdenyl bis-β-diketonate can be left in the chelate in order to enhance the stability of the chelate and be added to the lube oil together with the chelate. The formulated oil itself also tends to stabilize the chelate once it has been dissolved in the oil.

The molybdenyl chelates described herein are particularly useful as friction-reducing agents when added to a lubricating oil in combination with an oil-soluble, active sulfur donor. Examples of useful sulfur donors are: metal dihydrocarbyl dithiophosphates and their corresponding precursor esters; metal dihydrocarbyl dithiocarbamates; methylene bisdihydrocarbyldithiocarbamates; phosphorosulfurized pinenes; sulfurized olefins and hydrocarbons; sulfurized fatty esters; sulfurized alkyl phenols; and the like. In general, the active sulfur donor will be used in the lubricating composition at a concentration from about 0.01 to about five weight percent of the formulated oil, and preferably from about 0.2 to about two percent. By "oil-soluble active sulfur donor," as used herein, we mean those oil-soluble, sulfur-containing organic compounds, the presence of which in a lubricating oil formulation containing one or more of the molybdenyl chelates significantly enhances the improvement in the antifriction properties that is effected by the molybdenyl chelate. We believe that this may be the result of a synergistic cooperation between the molybdenyl chelate and the active sulfur donor.

Preferred are the zinc dihydrocarbyl dithiophosphates which are salts of dihydrocarbyl esters of dithiophosphoric acids and may be represented by the following formula:

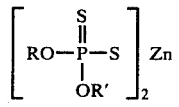

wherein R and R′ may be the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as R and R′ groups are alkyl groups of 2 to 8 carbon atoms. Thus, the radicals may, for example, be ethyl, n-propyl, i-propyl, n-butyl, i-butyl, sec-butyl, tert-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms in the dithiophosphoric acid will average about 5 or greater.

The zinc dihydrocarbyl dithiophosphates which are useful as the coadditive, i.e. sulfur donor, of the present invention, may be prepared in accordance with known techniques by first esterifying a dithiophosphoric acid, usually by reaction of an alcohol or phenol with $P_2S_5$ and then neutralizing the dithiophosphoric acid ester with a suitable zinc compound such as zinc oxide.

Equally suitable active sulfur donors are the dihydrocarbyl esters of dithiophosphoric acid which may be represented by the formula:

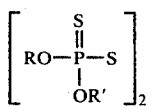

where R and R′ are defined above. Particularly useful is dibutylphenyl dithiophosphate.

The phosphorosulfurized terpenes as represented by pinene, dipenene, allo-ocimene, and the like, are another group of dithiophosphate diesters which are active sulfur donors. Of the terpenes, the bicyclic pinene is preferred. The phosphorosulfurized terpene is readily obtained by reaction of about one mole of diester of thiophosphoric acid and one mole of pinene at a temperature of at least 100° C., e.g. 100° C. to 200° C. The preferred active sulfur donor can be characterized as the bornyl ester of dihydrocarbyl ($C_2$–$C_{20}$) dithiophosphoric acid (as shown in U.S. Pat. No. 2,689,258).

The sulfurized olefins and hydrocarbons are further esters of thiophosphoric acids which are useful sulfur donors. These esters are achieved by reaction with olefins such as ethylene, propylene, isobutylene, decene, dodecene, octadecene, and the like, olefin polymers of molecular weight ranging from 100 to 50,000 such as ethylene, propylene, isobutylene, and the like, aromatics such as benzene, naphthylene, toluene, xylene, and the like, petroleum fractions and condensation products of halogenated aliphatic hydrocarbons with aromatic compounds, e.g. wax naphthalene (see U.S. Pat. No. 2,804,431).

The sulfurized fatty esters are another subclass of esters which are active sulfur donors. These products are readily obtained from the reaction of $P_2S_5$ and aliphatic alcohols usefully having from about 8 to 22 carbons obtained from natural sources including linoleic, palmitoleic, behenic, stearic, palmitic, lauric, capric, etc., as well as mixtures obtained from vegetable and animal oils such as tall oil.

The sulfurized alkyl phenols are generally $C_4$ to $C_{20}$ alkyl phenol sulfides. These sulfurized alkyl phenols are readily produced by sulfurizing an alkyl phenol with a sulfur halide or elemental sulfur.

Zinc dihydrocarbyldithiocarbamates which are also active sulfur donors are represented by the formula:

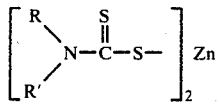

where R and R′ are defined above.

Methylene bis(dihydrocarbyldithiocarbamates) are used as ashless antioxidants and extreme pressure (EP) agents in motor oils. These are also useful as sulfur donors herein. They can be represented by the formula:

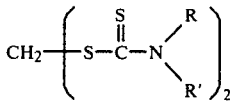

where R and R′ are defined above.

The lubricating oils of the present invention, in which the lubricating properties have been improved by the presence in solution of the molybdenyl chelate and the sulfur donor, are particularly suitable for use as motor oils in internal combustion engines such as are used in automobiles, trucks, motor-generator sets and the like. The expressions "hydrocarbon oils" and "hydrocarbon lubricating oil," as used herein, refer to base oils which consist primarily of hydrocarbon molecules, but the expressions contemplate the presence in mineral oils of relatively small amounts of naturally occurring sulfur, sulfur-containing hydrocarbons, and the like. The hydrocarbon oils can be obtained from naturally occurring sources such as petroleum, tar sands, shale oil, and the like, or they can be synthetic hydrocarbon oils, such as those obtained by polymerization of olefins, particularly 1-olefins, to the lubricating range such as the trimer and tetramer of 1-decene, and the like.

In addition to the molybdenum bis-β-diketonate and active sulfur donor, the lubricating oil composition may contain other well-known lubricating oil additives to provide trouble-free operation of the lubricated equipment, such as ashless dispersants, metallic detergents, supplemental oxidation and corrosion inhibitors, extreme pressure agents, rust inhibitors, pour point depressants, viscosity index improvers, etc.

DESCRIPTION OF PREFERRED EMBODIMENTS

Example 1

Preparation of molybdenyl bis(2,2,7-trimethyl-3,5-octanedionate)

A 10 g (0.03 mol) portion of solid molybdenyl bisacetylacetonate and 22 g (0.12 mol) of liquid 2,2,7-trimethyl-3,5-octanedione were placed in a 50 ml round bottom flask and heated for about one hour in an oil bath at 80° to 90° C. and a pressure of about 100 mm of mercury until the mixture became a brown homogeneous liquid. Acetylacetone formed by the exchange reaction was collected at 45° to 50° C. and a pressure of 30 mm Hg. An almost quantitative amount of acetylacetone was recovered, and an infrared spectrum confirmed its structure. The excess unreacted 2,2,7-trimethyl-3,5-octanedione was distilled off at 100° to 105° C. and at 30 mm Hg pressure. The brown residue was dissolved in hexane, gravity filtered, and hexane was removed under reduced pressure. A 14.5 g quantity of the brown viscous product was obtained (96.6% yield). The elemental analysis calculated for $MoO_6C_{22}H_{18}$ is: Mo, 19.4%; C, 53.4%; H, 7.7%. Found was Mo, 19.0%; C, 54.43%; H, 7.56%. Infrared spectrum (neat) analysis showed two strong bands at 915 and 940 $cm^{-1}$ for cis Mo=O. The structure was confirmed by proton nmr analysis.

When the product was dissolved in hexane and permitted to stand for two days, about 20 percent decomposed to a blue precipitate which was found by analysis to contain 31 percent molybdenum.

Examples 2–9

A series of molybdenyl chelates, including the molybdenyl chelate prepared in Example 1, were tested as antifriction agents in a formulated motor oil. Two tests were also carried out using the molybdenyl chelate prepared in Example 1, admixed with some of the free β-diketone from which it was made.

To evaluate the additives, the Optimol SRV-Tester, a friction simulation machine manufactured by Optimol Ölwerke, GmbH, Munich, West Germany, was employed. The tester comprises a static specimen support with a mobile and replaceable fixture. The selected specimens to be tested were put under load by an electronically controlled loading device. A reciprocating movement was produced in a moving-coil system and transferred to the mobile specimen fixture. The ball-on-disc and cylinder-on-disc modes were used in these evaluations. The two sets of conditions that were applied in the tests are set out in Table I.

TABLE I

| Test Conditions | I | II |
|---|---|---|
| Test mode | ball on disc | cylinder on disc |
| Load | 100 newton | 15 newton |
| Amplitude | 100 μm | 3000 μm |
| Frequency | 50 hertz | 50 hertz |
| Temperature | 120° C. | 180° C. |
| Test duration | 1 hr. | 2 hrs. |

Minimum and maximum coefficients of friction were obtained from strip chart recordings. The percent friction reduction was calculated using the minimum coefficient of friction of each sample and the minimum coefficient of friction of the control oil.

The experiments were carried out using a commercial grade automotive motor oil which contained 46.6 volume percent of a light neutral oil, 40 percent of a medium neutral oil, 6.1 percent of a commercial additive package which provided about one percent of a zinc dialkyl dithiophosphate and about 4 to 5 percent of a succinimide-type dispersant to the oil, and about 2.9 percent of a viscosity index improver (and 4.4% oil carrier). The 40° C. viscosity of the oil was 77.1 $mm^2/s$ (cSt) and the 100° C. viscosity was 13.34 $mm^2/s$ (cSt).

The results showing the reduction in the coefficient of friction of the lubricating oil when the molybdenyl chelate additives were present are set out in Table II. In each example, one percent of the additive was used except as noted.

TABLE II

| Ex. | Additive | Test condition | Coefficient of friction maximum | Coefficient of friction minimum | % friction reduction |
|---|---|---|---|---|---|
| | none | I | 0.181 | 0.1655 | — |
| | none | II | 0.350 | 0.328 | — |
| 2 | A | I | 0.202 | 0.075 | 54.7 |
| 3 | A | II | 0.282 | 0.243 | 25.9 |
| 4 | 58% A + 42% A' | II | 0.285 | 0.250 | 23.8 |
| 5 | (58% A + 42% A')[a] | II | 0.235 | 0.195 | 40.5 |
| 6 | B | II | 0.330 | 0.205 | 37.5 |
| 7 | C | II | 0.264 | 0.20 | 39.0 |
| 8 | D | II | 0.265 | 0.241 | 26.5 |
| 9 | E | II | 0.255 | 0.215 | 34.5 |

[a]two weight percent added
A molybdenyl bis(2,2,7-trimethyl-3,5-octanedionate)
A' 2,2,7-trimethyl-3,5-octanedione
B molybdenyl bis(4,6-nonanedionate)
C molybdenyl bis(3,5-heptanedionate)
D molybdenyl bis(2,4-hexanedionate)
E molybdenyl bis(6-methyl-2,4-heptanedionate)

Examples 10–14

A series of experiments were carried out to determine the relative effects of a molybdenyl bis-β-diketonate and two different sulfur donors on the coefficient of friction of a formulated automotive lubricating oil containing conventional additives. Each test oil including a control contained 1.6 percent of an ashless dispersant, one percent calcium sulfonate and three percent of an acryloid-type VI improver. The results obtained with the Optimol SRV-Tester using test conditions I (Table I) are set out in Table III. The percent reduction or increase in the coefficient of friction in each instance was calculated using the minimum coefficient of friction of each test oil and the minimum coefficient of friction of the control oil.

TABLE III

| Example | Control | 10 | 11 | 12 | 13 | 14 |
|---|---|---|---|---|---|---|
| Component, wt % | | | | | | |
| mineral oil | 94.4 | 93.4 | 93.4 | 93.4 | 92.4 | 92.4 |
| ZDDP[a] | — | — | 1.0 | — | 1.0 | — |
| MDDC[b] | — | — | — | 1.0 | — | 1.0 |
| molybdenyl chelate[c] | — | 1.0 | — | — | 1.0 | 1.0 |
| SRV friction test | | | | | | |
| Coef. of friction | | | | | | |
| maximum | 0.202 | 0.166 | 0.193 | 0.183 | 0.176 | 0.171 |
| minimum | 0.154 | 0.143 | 0.183 | 0.170 | 0.054 | 0.062 |
| % friction reduction | — | 7.14 | — | — | 64.9 | 59.7 |
| % friction increase | — | — | 18.8 | 10.4 | — | — |

[a]sulfur donor, zinc dialkyldithiophosphate (Lubrizol 1395)
[b]sulfur donor; methylene bis(dibutyldithiocarbamate)
[c]molybdenyl bis(2,2,7-trimethyl-3,5-octanedionate)

It is to be understood that the above disclosure is by way of specific example and that numerous modifications and variations are available to those of ordinary skill in the art without departing from the true spirit and scope of the invention.

We claim:

1. A lubricating oil composition having improved antifriction properties comprising a major portion of a hydrocarbon lubricating oil and in solution (a) between about 0.01 and about five weight percent of an active organic sulfur donor and (b) between about 0.05 and about six weight percent of a molybdenyl bis-β-diketonate having the general formula:

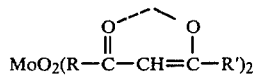

where R and R' are independently selected from the group consisting of alkyl, aryl, aralkyl, alkaryl and cycloalkyl radicals containing from one to about twelve carbon atoms, and the sum of the carbon atoms in R and R' is three to about 24 carbon atoms.

2. A lubricating oil composition in accordance with claim 1 in which R and R' are independently selected from branched-chain alkyl having from three to about eight carbon atoms.

3. A lubricating oil composition in accordance with claim 1 in which R and R' independently contain from one to about six carbon atoms, and the sum of the carbon atoms in R and R' is from three to about twelve.

4. A lubricating oil composition in accordance with claim 1 in which the lubricating oil composition comprises between about 0.2 and about three weight percent of the molybdenyl bis-β-diketonate.

5. A lubricating oil composition in accordance with claim 1 in which the sulfur donor is selected from metal dihydrocarbyldithiophosphates and the corresponding precursor esters thereof, metal dihydrocarbyldithiocarbamates, methylene bisdihydrocarbyldithiocarbamates, phosphorosulfurized pinenes, sulfurized olefins and hydrocarbons, sulfurized fatty esters and sulfurized alkyl phenols.

6. A lubricating oil composition in accordance with claim 5 in which the lubricating oil composition comprises from about 0.2 to about two weight percent of the active sulfur donor.

* * * * *